US007909712B2

(12) United States Patent
Boyles

(10) Patent No.: US 7,909,712 B2
(45) Date of Patent: Mar. 22, 2011

(54) METHOD OF LAYING OUT A BASEBALL DIAMOND

(76) Inventor: Jeffrey D. Boyles, Saint Joseph, MO (US)

( * ) Notice: Subject to any disclaimer, the term of this patent is extended or adjusted under 35 U.S.C. 154(b) by 21 days.

(21) Appl. No.: 12/360,156

(22) Filed: Jan. 27, 2009

(65) Prior Publication Data

US 2010/0190589 A1 Jul. 29, 2010

(51) Int. Cl.
*A63B 71/00* (2006.01)

(52) U.S. Cl. ..... 473/490

(58) Field of Classification Search ..... 473/490, 473/499, 500; 33/755, 756, 1 H, 759
See application file for complete search history.

(56) References Cited

U.S. PATENT DOCUMENTS 3,668,781 A 6/1972 Teter
4,160,324 A 7/1979 Dunn
4,162,789 A * 7/1979 Hollaway ..... 473/499
5,371,949 A * 12/1994 Delaurier ..... 33/1 G
5,556,090 A * 9/1996 Coleman ..... 473/468
6,893,365 B2 * 5/2005 Rathbun et al. ..... 473/500
2006/0010705 A1 1/2006 Dettellis

* cited by examiner

*Primary Examiner* — Raleigh W. Chiu
(74) *Attorney, Agent, or Firm* — Dale J. Ream

(57) ABSTRACT

A method of laying out a baseball diamond includes providing home, first, and third bases. A second base includes a measuring tape coupled to a reel. The method includes withdrawing an amount of tape corresponding to a desired distance between second and home bases. A first stake is placed in a home plate hole and the tape is hooked thereto. A second stake is inserted into a second base hole and the tape is extended between the bases. The tape is partially withdrawn into the second base, leaving a desired distance corresponding between the second and first bases. The second base is then rotated about the second stake and the first base is placed at a distance indicated by corner base indicia on the tape. The second base is rotated about the second stake and the third base is placed at a distance indicated by the corner base indicia.

3 Claims, 12 Drawing Sheets

METHOD OF LAYING OUT A BASEBALL DIAMOND

BACKGROUND OF THE INVENTION

This invention relates to a method for laying out a baseball diamond and, more particularly, to a method that provides a second base having an integrated reel with a tape measure. Further, the present method provides a method for first placing home plate relative to the second base and then alternately rotating the second base to then properly position first and third bases.

Youth baseball and softball leagues often do not have enough diamonds on which all of the teams in the league can practice simultaneously. The use of other available spaces is often undesirable in that the space is not properly laid out with authentic dimensions to provide a meaningful baseball or softball practice. Laying out the available space to correctly emulate a permanent diamond takes a lengthy amount of time and, even then, may not be accurate. In addition, the process of laying out a temporary ball diamond may need to be performed repeatedly each time a new space is chosen for practice.

Various devices and methods have been proposed for quickly and conveniently laying out a temporary baseball or softball diamond. Although assumably effective for their intended purposes, these devices and methods have not provided a method and device integrating a reel and tape into a second base such that the base may be used first to position home plate and then appropriately rotated to accurately position first and third bases. In addition, integrating the necessary components into home plate is undesirable in that the plate may extend above a ground surface or must be partially buried each time a new temporary field is set up.

Therefore, it would be desirable to have a method for laying out a baseball field that overcomes the limitations of the prior devices and proposals.

SUMMARY OF THE INVENTION

A method of laying out a baseball diamond according to the present invention includes providing a home plate, first base, pitching rubber, and third base. A second base is provided that includes a measuring tape coupled to a reel and including a mechanism for locking selective amounts of the measuring tape extended from the reel. The method includes withdrawing from the reel a desired amount of tape corresponding to a desired distance between second and home bases. A first stake is placed in a home plate hole and the tape is hooked thereto. A second stake is inserted into a second base hole and the tape is extended between the bases. The pitching rubber is placed at a position indicated along the tape. An amount of tape is withdrawn into the second base, leaving extending an amount of tape corresponding with a desired distance between the second base and the first base. The second base is then rotated about the second stake and the first base is placed at a distance indicated by corner base indicia on the measuring tape. Then the second base is rotated about the second stake and the third base is placed at a distance indicated by the corner base indicia. Finally, the hook element is separated from the first stake and allowed to reenter the reel.

Therefore, a general object of this invention is to provide a method for laying out a baseball diamond for temporary use.

Another object of this invention is to provide a method, as aforesaid, that integrates a measuring tape into a second base member.

Still another object of this invention is to provide a method, as aforesaid, that enables a user to identify the location of home plate, first base, and third base relative to second base by rotating second base appropriately and extending an integrated measuring tape from a reel situated in the second base.

Yet another object of this invention is to provide a method, as aforesaid, that enables a user to quickly lay out ball diamonds of selected dimensions.

A further object of this invention is to provide a method, as aforesaid, that provides for proper placement of a pitching rubber at the same time home plate is being placed relative to second base.

A still further object of this invention is to provide a method, as aforesaid, that is easy to use by a consumer.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
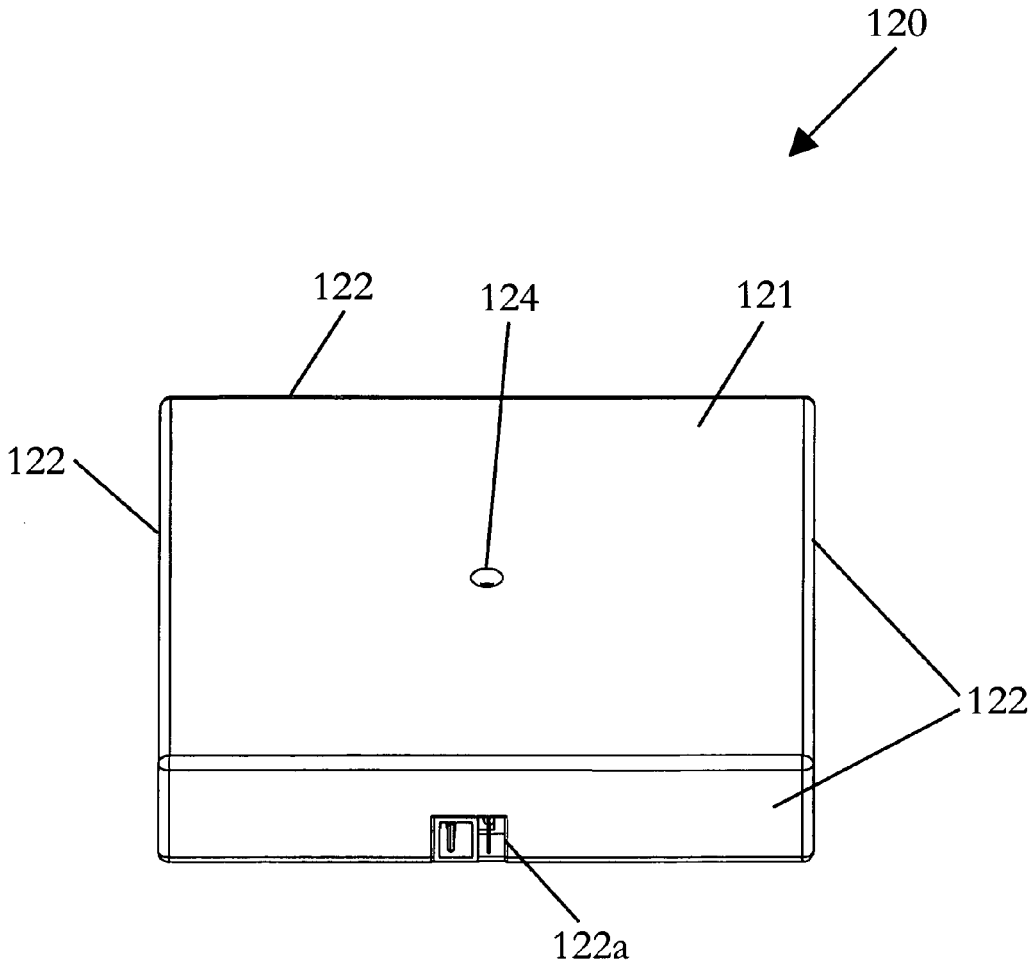
FIG. 1 is a front perspective view of a second base according of a method of laying out a baseball diamond according to a preferred embodiment of the present invention.

Methods of laying out a baseball diamond will now be described in detail with reference to FIG. 1 through FIG. 12 of the accompanying drawings. As shown in FIG. 12, a first base 110, a second base 120, a third base 130, a home plate 140, and a pitching rubber 150 are provided. The first base 110, third base 130, and pitching rubber 150 may, for example, be of traditional configuration and construction. It should be understood that "baseball" is used herein to refer to baseball, softball, and/or teeball, including various levels of play (e.g., professional, collegiate, youth, etc.).

Figure 11:
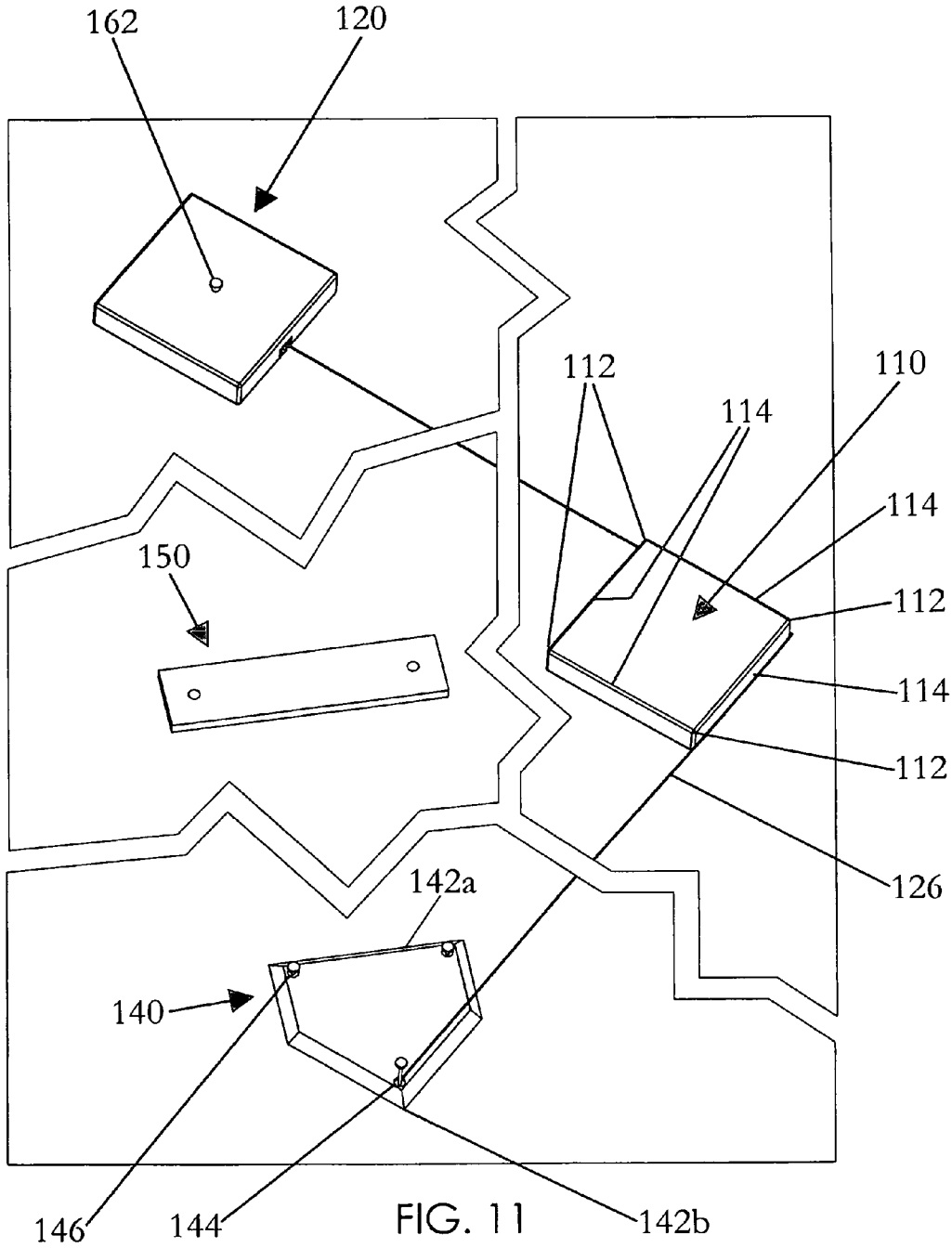
FIG. 11 is a perspective view of the plan view illustrated in FIG. 10.
Figure 12:
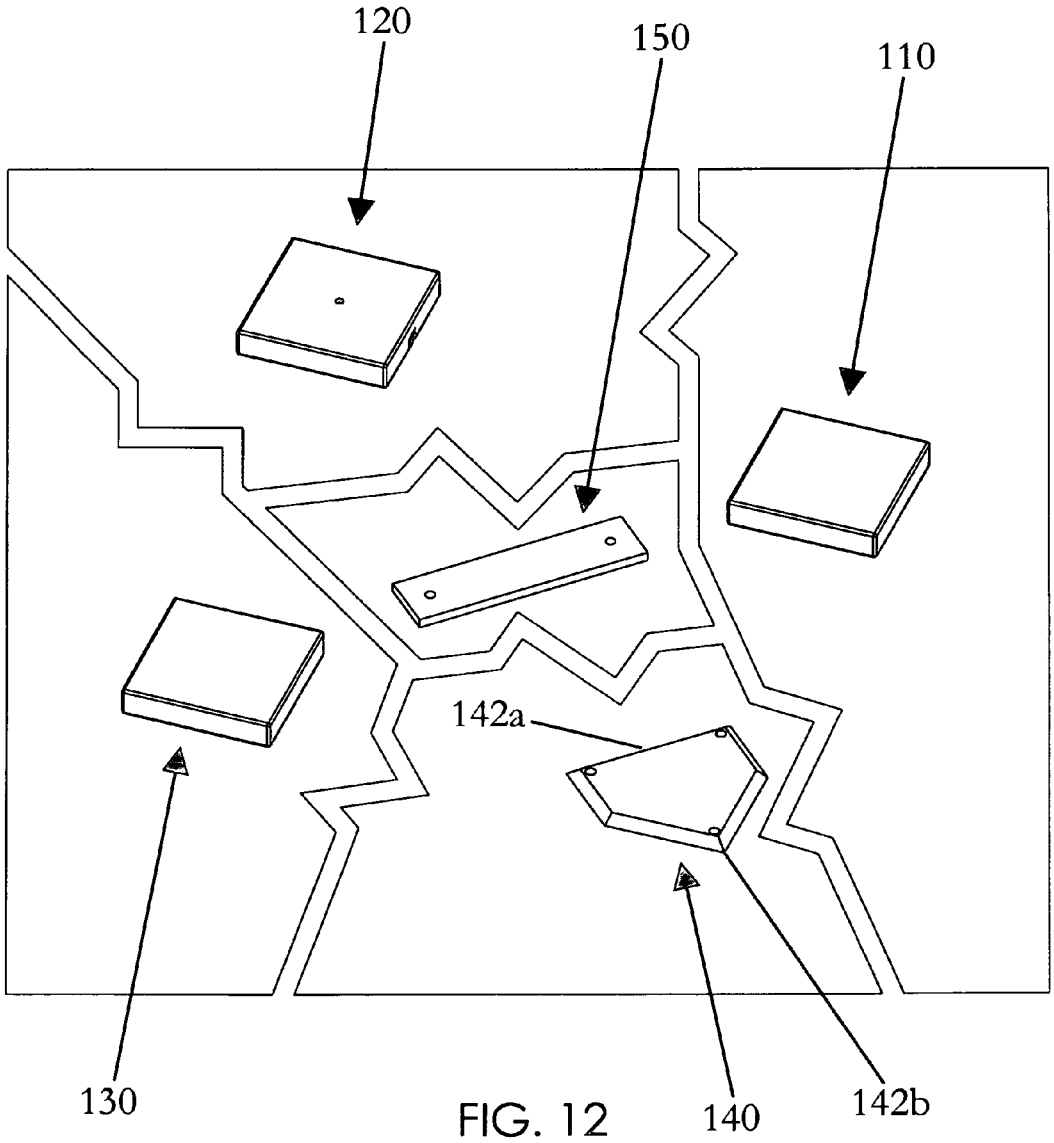
FIG. 12 is a fragmentary perspective view illustrating a completely laid out baseball diamond.

As shown in FIGS. 11 and 12, the home plate 140 has a configuration of an irregular pentagon with a front end 142*a* and a rear point 142*b*. The home plate 140 has a hole 144 adjacent the rear point 142*b* and another hole 146.

As shown in FIGS. 1 through 5, the second base 120 has a generally square top 121, four sides 122, and an interior area 123 between the top 121 and the sides 122. A center hole 124 extends from the top 121 through the interior area 123. The second base 120 has a reel 125 (FIG. 3*a*) in the interior area 123 and a measuring tape 126 coupled to the reel 125. One of the sides 122 has an opening 122*a* to pass the measuring tape 126 through. The measuring tape 126 has a distal end 126*a* with a hook element 127, such as the loop shown in FIG. 3*b*, and the measuring tape 126 may be constructed of any appropriate material, such as fabric, cloth, flexible metal, etc.

Figure 3A:
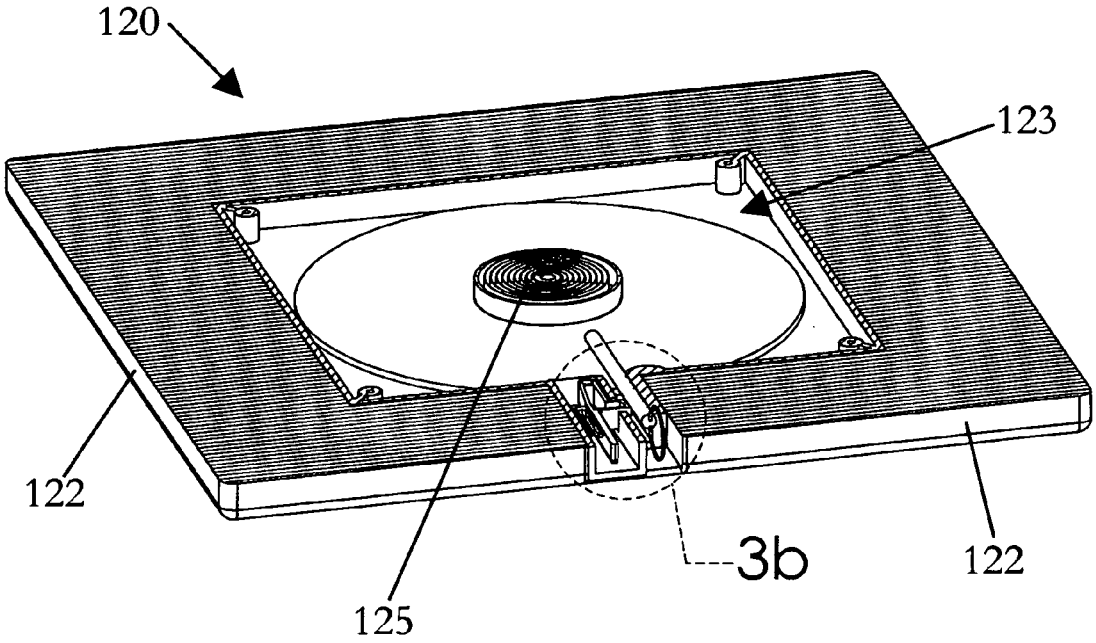
FIG. 3*a* is a fragmentary view of the second base as in FIG. 2.
Figure 3B:
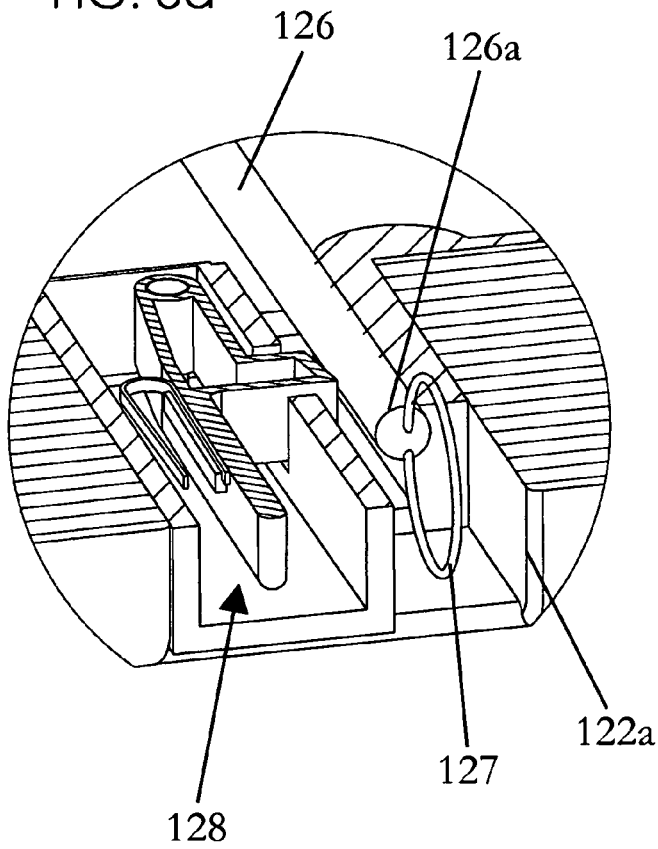
FIG. 3*b* is an isolated view on an enlarged scale of a portion of FIG. 3*a;*
Figure 4:
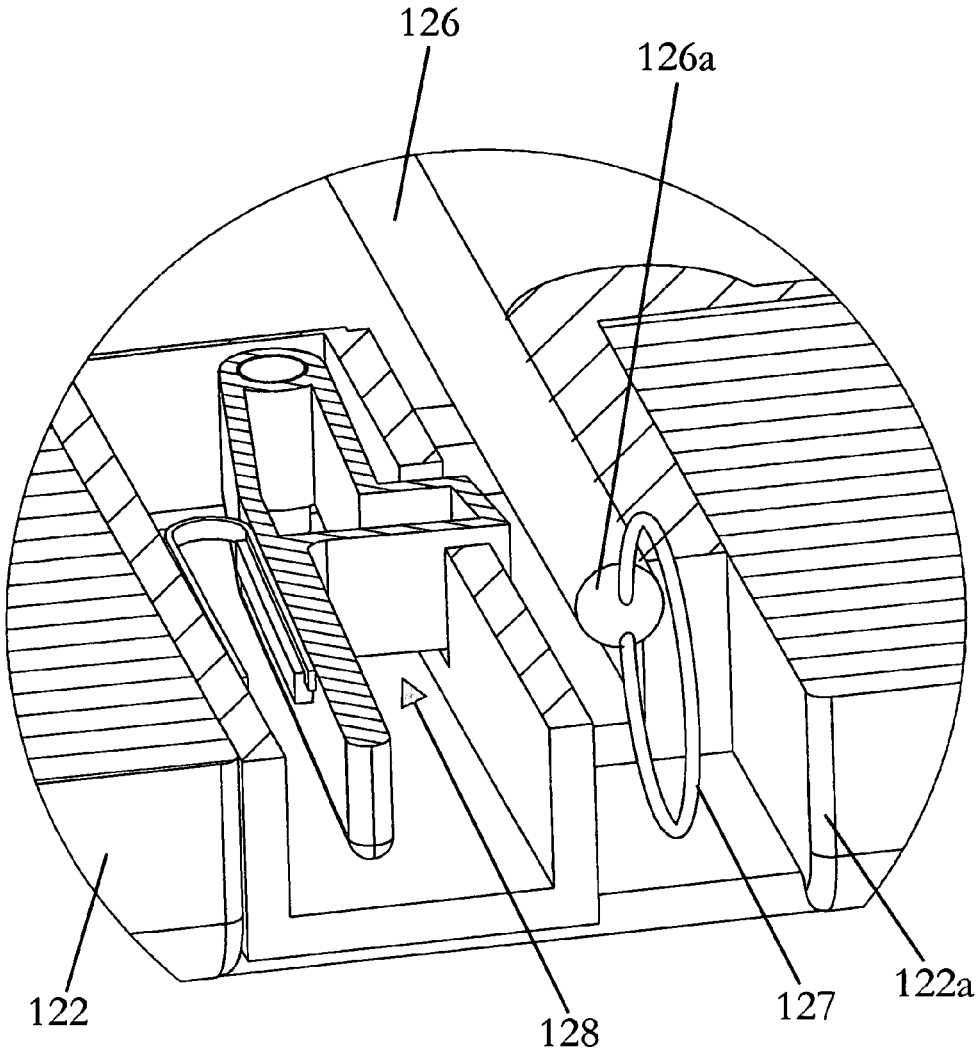
FIG. 4 is another isolated view on an enlarged scale as in FIG. 3*b;*
Figure 5:
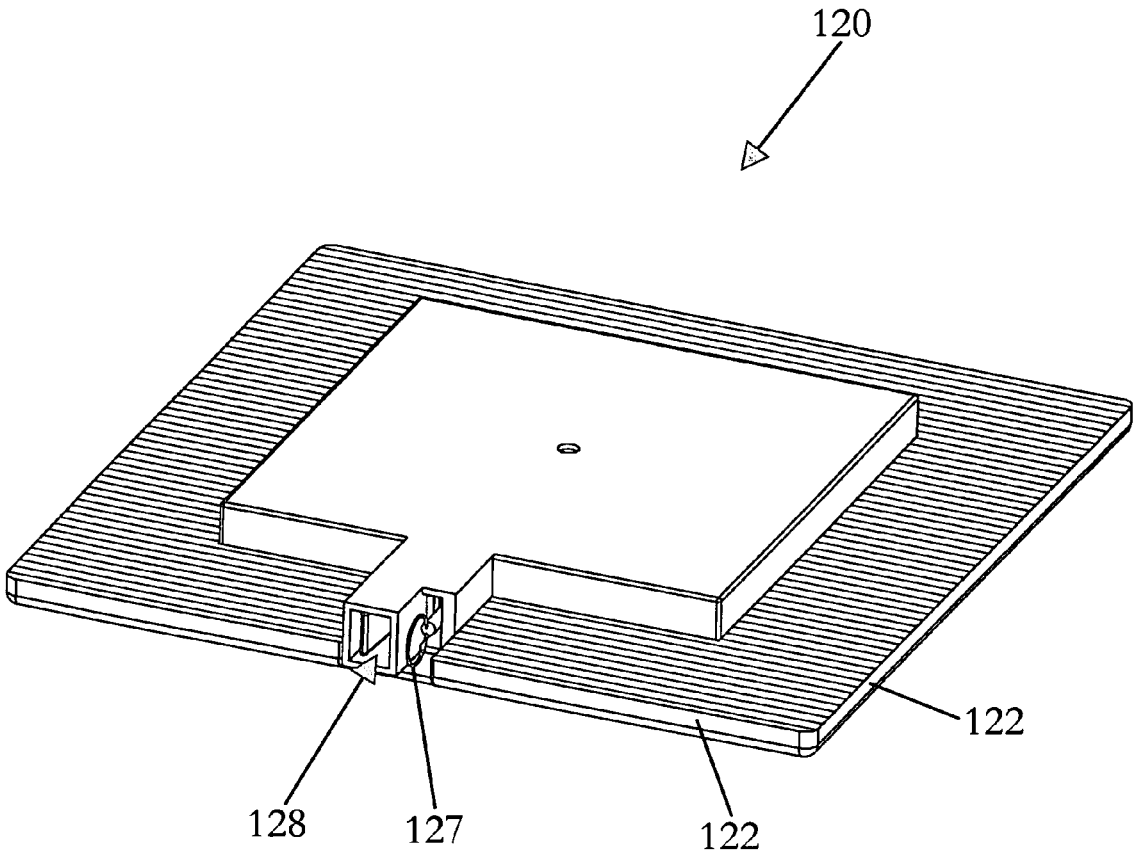
FIG. 5 is a perspective view of a second base having another configuration.

Means may be included for selectively locking amounts of the measuring tape 126 that have passed through the second base side opening 122*a*. The locking means may be a clamping device 128 (a device that clamps the measuring tape 126), as shown in FIGS. 3*b* and 4, a device that interacts with the reel 125, or another appropriate lock. Means may also be included for causing the reel 125 to turn and amounts of the measuring tape 126 to pass through the second base side opening 122*a* into the interior area 123. In some embodiments, the reel turning means is a spring in communication with the reel 125. Other appropriate reel turning means, for example, include a hand crank and an electric motor.

Figure 7:
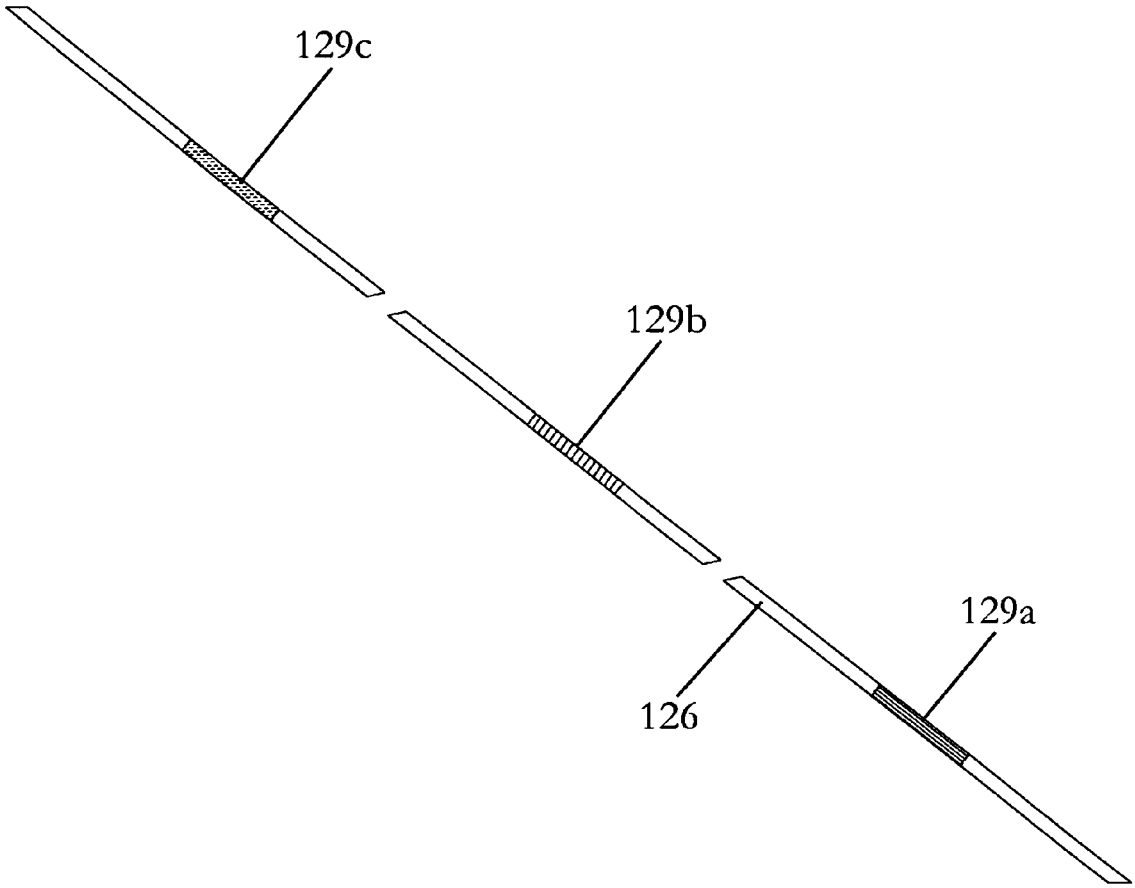
FIG. 7 is a fragmentary view of a measuring tape according to the present invention.
Figure 8:
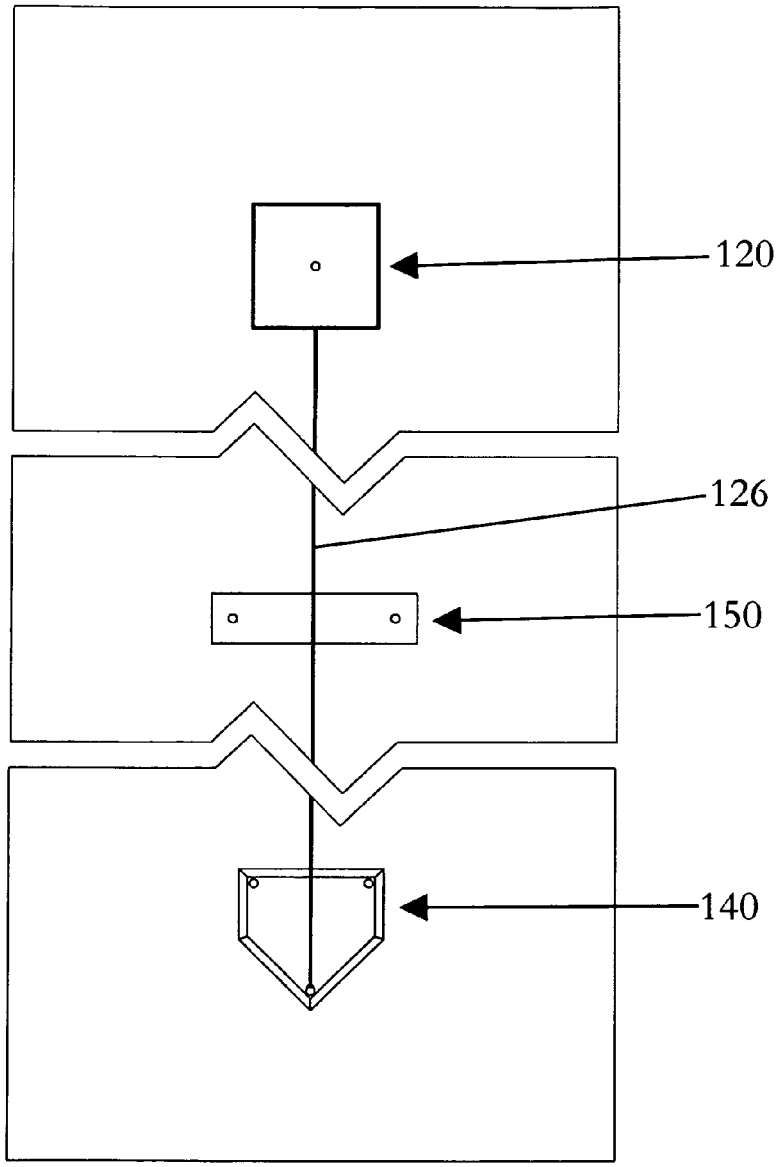
FIG. 8 is a fragmentary plan view illustrating placement of a home plate and pitching rubber in relation to the second base according to the method of the present invention.
Figure 9:
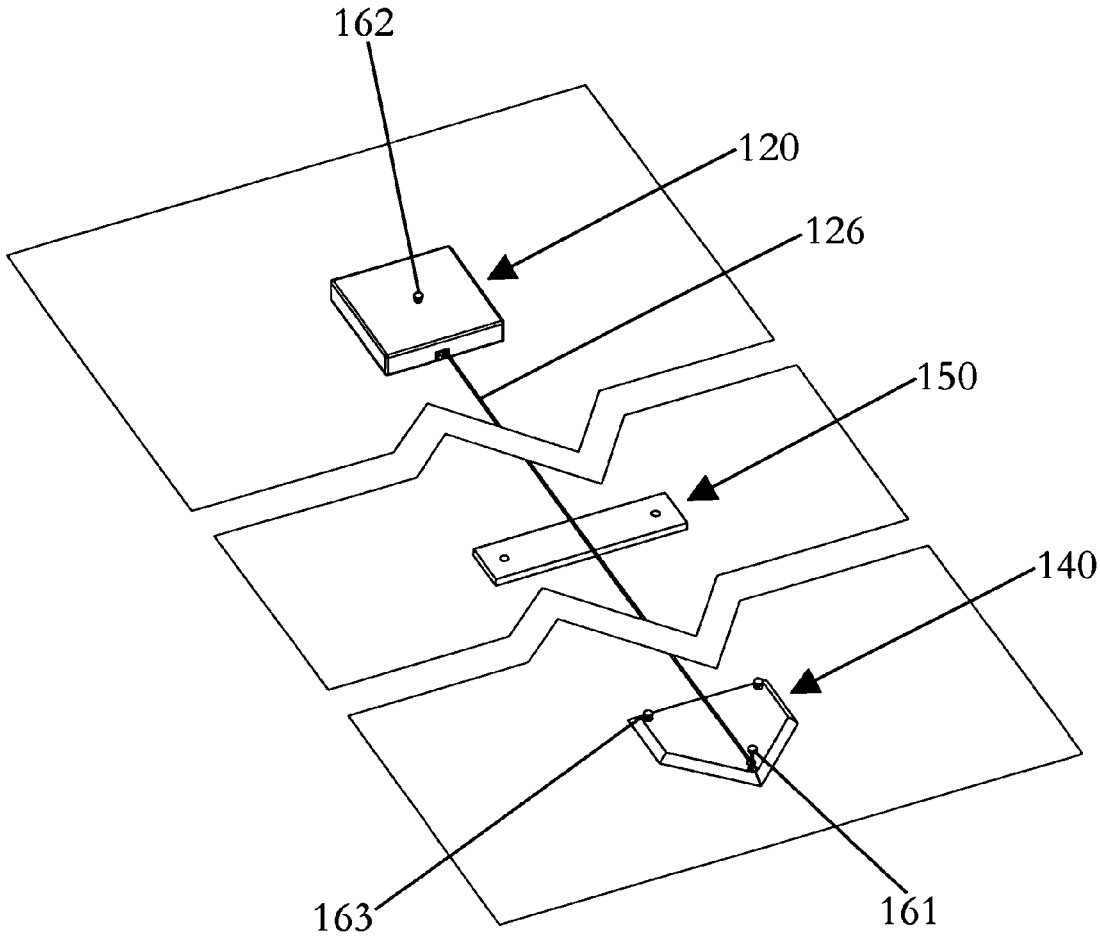
FIG. 9 is a perspective view of the plan view illustrated in FIG. 8.

As shown in FIGS. 8 and 9, a first amount of the measuring tape 126 that corresponds to a desired distance between the home plate 140 and the second base 120 is withdrawn from the second base 120 (i.e., from the interior area 123 through the second base opening 122*a*). Various distances may be marked on the measuring tape 126 to correspond to different sizes of baseball diamonds, as shown in FIG. 7 by markings 129*a*, 129*b*, 129*c*, and the user may select the desired distance. The locking means may be used to temporarily restrain the first amount of measuring tape 126 from reentering the interior area 123, which may be particularly useful if the reel turning means are automated (e.g., spring operated, etc.).

Figure 2:
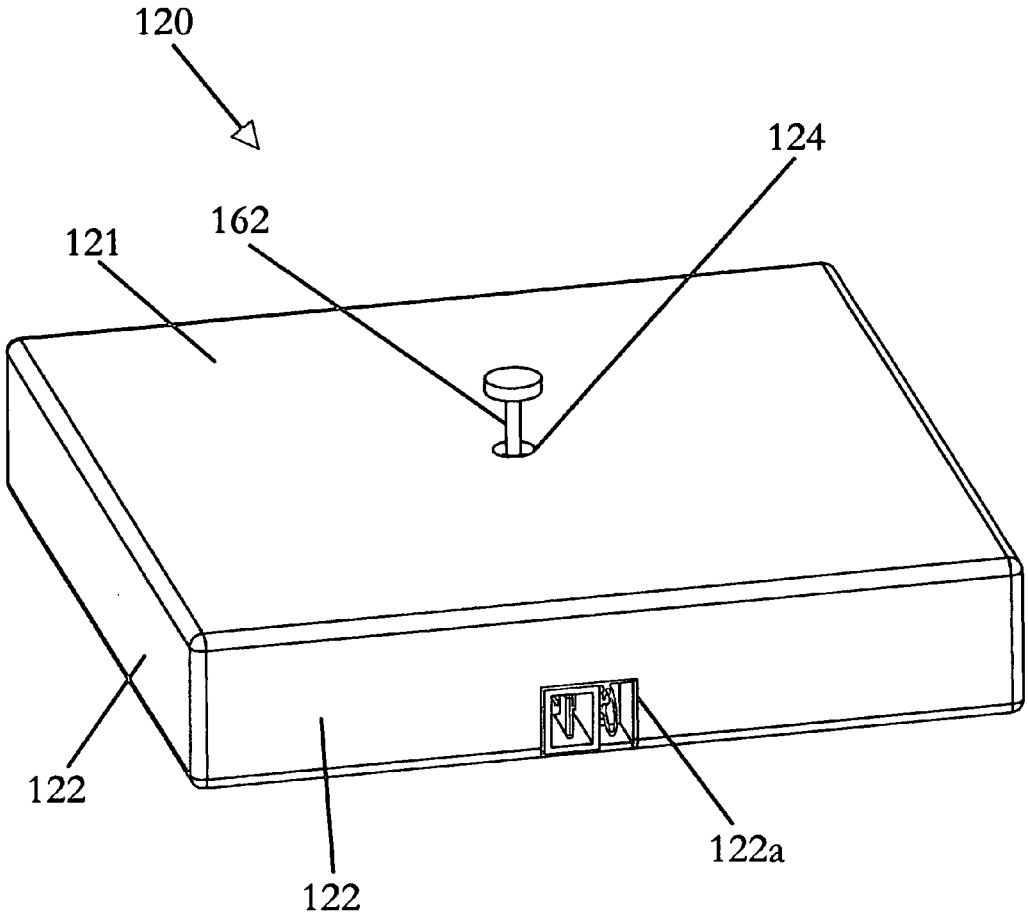
FIG. 2 is a perspective view from another angle of the second base as in FIG. 1.
Figure 6:
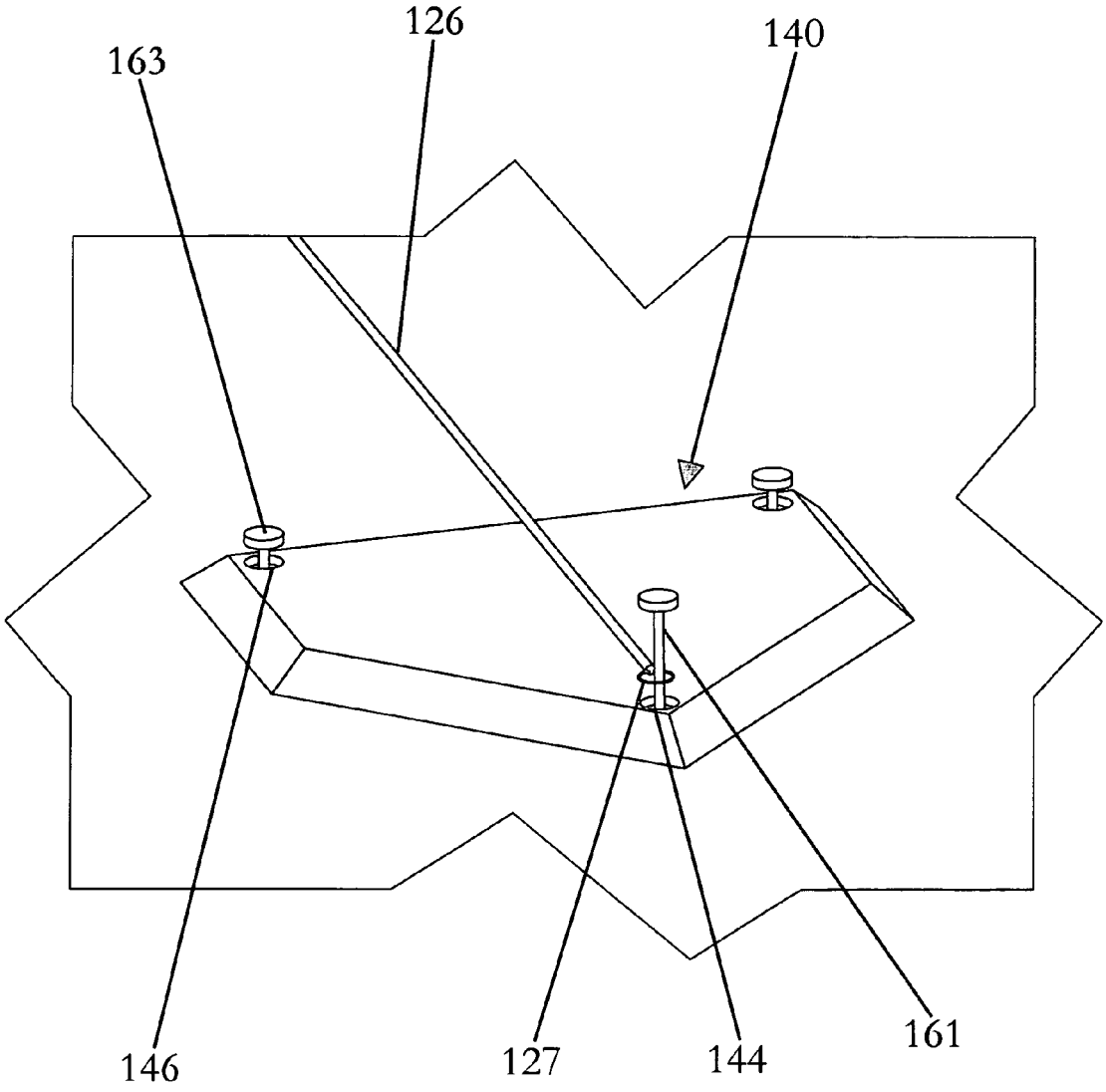
FIG. 6 is a fragmentary view of a home plate being placed according to the method of the present invention.

A first stake 161 is placed through the home plate hole 144, and the hook element 127 is coupled to the first stake 161 (FIGS. 6, 8, and 9). Similarly, a second stake 162 is placed through the second base hole 124 (FIG. 2). The user then forces either the first stake 161 or the second stake 162 into a ground surface, outstretches the first amount of measuring tape 126, and forces the other stake 161, 162 into the ground surface such that the outstretched first amount of measuring tape 126 extends between the home plate 140 and the second base 120. As shown in FIG. 9, the pitching rubber 150 is placed at a distance indicated by the measuring tape 126 while the outstretched first amount of measuring tape 126 extends between the home plate 140 and the second base 120, and a third stake 163 may be placed through the home plate hole 146 and forced into the ground surface after the first stake 161 is situated.

Figure 10:
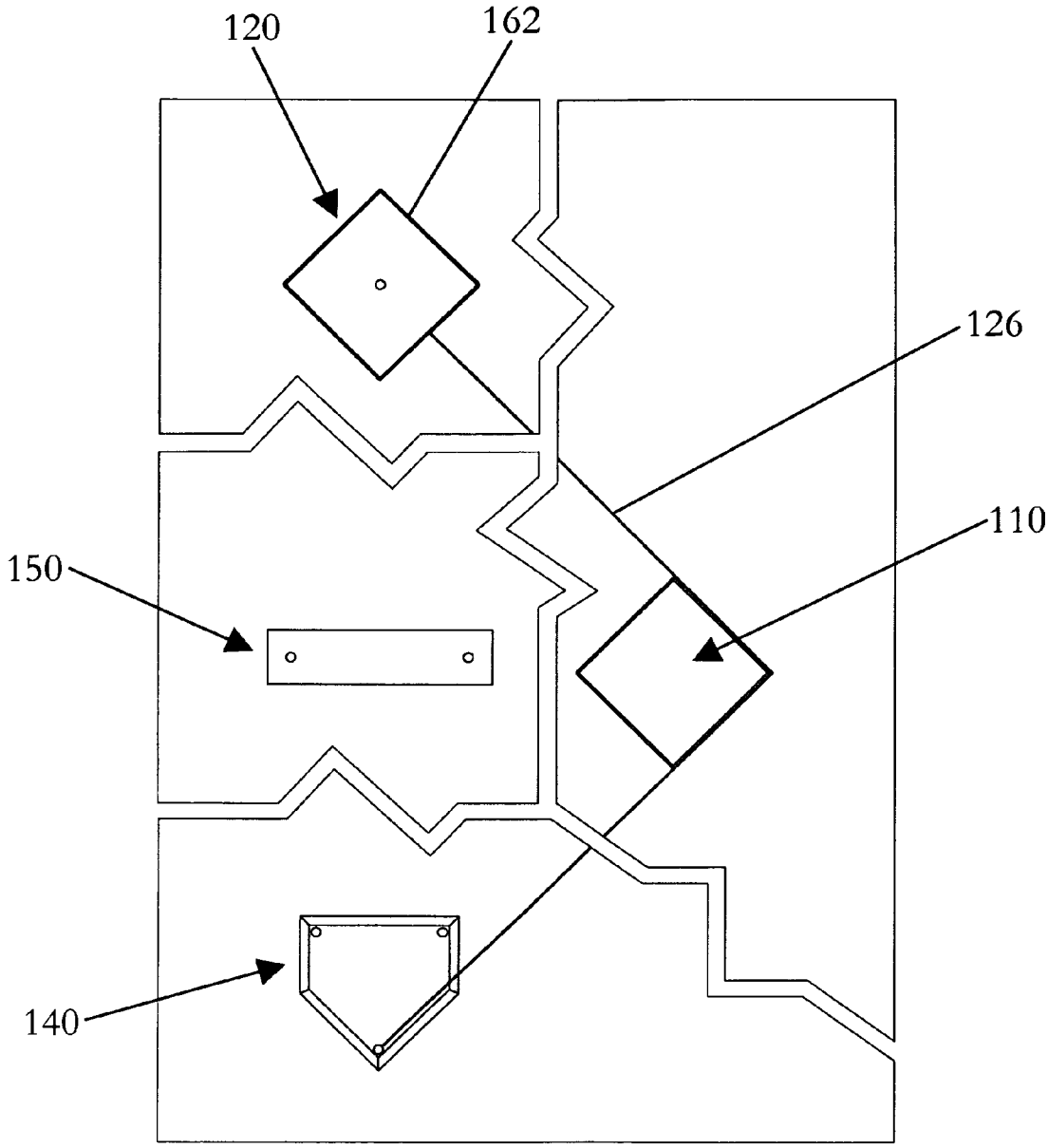
FIG. 10 is a fragmentary plan view illustrating placement of a first base according to the method of the present invention.

After the home plate 140 and the second base 120 are positioned as set forth above, more of the measuring tape 126 is withdrawn from the second base 120 (i.e., from the interior area 123 through the second base opening 122*a*) so that a second amount of the measuring tape 126 is outside the interior area 123. The locking means may be used to temporarily restrain the second amount of measuring tape 126 from reentering the interior area 123. As shown in FIGS. 10 and 11, the second amount of measuring tape 126 corresponds to the sum of a desired distance between the home plate 140 and the first base 110 and a desired distance between the first base 110 and the second base 120. As set forth above, the measuring tape may have markings for various distances to correspond to different sizes of baseball diamonds; the markings used (e.g., for a small diamond, a large diamond, etc.) should be consistent throughout the process.

The second base 120 is rotated about the stake 162 (compare FIG. 8 to FIG. 10, for example), and, as shown in FIGS. 10 and 11, the first base 110 is placed at a distance indicated by corner base indicia on the measuring tape 126 while the second amount of measuring tape 126 is outside the interior area 123, the measuring tape 126 is outstretched between the hook element 127 coupled to the first stake 161 and the corner base indicia, and the measuring tape 126 is outstretched between the corner base indicia and the second base 120. The corner base indicia, like the other measuring tape markings discussed above, may be selected by the user (e.g., from small diamond indicia, large diamond indicia, etc.) and should be selected to be consistent with the other measurements used. As shown in FIG. 11, the first base 110 has four corners 112 and four sides 114, and the first base 110 may be placed such that a respective corner 112 is at the corner base indicia on the measuring tape 126 and the measuring tape 126 extends along two respective sides 114.

Placement of the third base 130 is very similar to placement of the first base 110, and may be done before or after the first base 110 is placed. The second base 120 is rotated about the stake 162, and the third base 130 is placed at a distance indicated by the corner base indicia on the measuring tape 126 while the second amount of measuring tape 126 is outside the interior area 123, the measuring tape 126 is outstretched between the hook element 127 coupled to the first stake 161 and the corner base indicia, and the measuring tape 126 is outstretched between the corner base indicia and the second base 120. The corner base indicia used to place the third base 130 is the same corner base indicia used to place the first base 110. Similar to the first base 110, the third base 130 has four corners and four sides, and the third base 130 may be placed such that a respective corner is at the corner base indicia on the measuring tape 126 and the measuring tape 126 extends along two respective sides.

After the first, second, and third bases 110, 120, 130, the home plate 140, and the pitching mound 150 are placed, the hook element 127 is separated from the first stake 161 and the first stake 161 may be forced further into the ground surface. And the second stake 162 may be removed from the second base hole 124. The reel turning means is used to turn the reel 125 and retract the measuring tape 126 through the second base side opening 122*a* and into the interior area 123. If the locking means was used (FIG. 3*b*), its release may be required (FIG. 4) before the measuring tape 126 may be retracted.

It is understood that while certain forms of this invention have been illustrated and described, it is not limited thereto except insofar as such limitations are included in the following claims and allowable functional equivalents thereof.

The invention claimed is:

1. A system for laying out a baseball diamond, comprising:

a first base, a third base, and a pitching rubber;

a home plate having a configuration of an irregular pentagon with a front end and a rear point, said home plate having a hole adjacent said rear point;

a second base having a generally square top and four sides and an interior area therebetween, said second base having a reel in said interior area and a measuring tape coupled to said reel, said measuring tape having a distal end with a hook element, one said second base side having an opening to pass said measuring tape through, said second base having a center hole extending from said top through said interior area;

wherein said reel is rotatable such that a first amount of said measuring tape is selectively withdrawn through said second base opening corresponding to a desired distance between said home plate and said second base;

a first stake having a configuration that is complementary to a configuration of said home plate hole and that is selectively receivable therein, said first stake having means for being coupled to said hook element of said measure tape;

a second stake having a configuration complementary to a configuration of said second base hole and that is selectively receivable therein;

wherein said first and second stakes include a configuration that selectively pierces a ground surface;

wherein said measuring tape includes an indicator associated with a predetermined placement of said pitching rubber when said measuring tape is extended between said home plate and said second base;

wherein said reel is operable so that a second amount of said measuring tape is selectively withdrawn from said interior area through said second base opening and such that said second amount of said measuring tape is outside said interior area, said second amount of said measuring tape corresponding to the sum of a desired distance between said home plate and said first base and a desired distance between said first base and said second base;

wherein said reel is rotatable about said second stake such that a corner base indicia on said measuring tape indicates a position at which said first base is to be positioned, said corner base indicia being viewable when said second amount of said measuring tape is outside said interior area and when said measuring tape is outstretched between said hook element coupled to said first stake and said corner base indicia and while said measuring tape is outstretched between said corner base indicia and said second base; and wherein said reel is rotatable about said second stake such that a corner base indicia on said measuring tape indicates a position at which said third base is to be positioned, said corner base indicia being viewable when said second amount of said measuring tape is outside said interior area and when said measuring tape is outstretched between said hook element coupled to said first stake and said corner base indicia and while said measuring tape is outstretched between said corner base indicia and said second base.

2. The system ac in claim 1, wherein said home plate defines a second hole; said system further comprising a third stake configured to be selectively received through said second hole, said third stake also having an end configured to selectively penetrate a ground surface.

3. The system as in claim 2, wherein said hook element is removable from said first stake.

* * * * *